United States Patent [19]

Yagi et al.

[11] Patent Number: 4,889,085

[45] Date of Patent: Dec. 26, 1989

[54] VALVE OPERATING DEVICE FOR INTERNAL COMBUSTION ENGINE

[75] Inventors: Toru Yagi, Tokyo; Yoshihiro Fujiyoshi, Kanagawa; Takatoshi Aoki, Tokyo; Yasuhiro Urata, Saitama, all of Japan

[73] Assignee: Honda Giken Kogyo Kabushiki Kaisha, Tokyo, Japan

[21] Appl. No.: 273,459

[22] Filed: Nov. 18, 1988

[30] Foreign Application Priority Data

Nov. 19, 1987 [JP] Japan ..... 62-292623

[51] Int. Cl.[4] ..... F01L 9/02

[52] U.S. Cl. ..... 123/90.12; 123/90.55; 123/90.57

[58] Field of Search ..... 123/90.12, 90.13, 90.15, 123/90.16, 90.48, 90.49, 90.55, 90.56, 90.57, 90.58, 90.59

[56] References Cited

U.S. PATENT DOCUMENTS

| | | | |
|---|---|---|---|
| 4,153,016 | 5/1979 | Hausknecht | 123/90.15 |
| 4,278,233 | 7/1981 | Zurner et al. | 123/90.12 |
| 4,347,812 | 9/1982 | Kosuda et al. | 123/90.55 |
| 4,452,186 | 6/1984 | List et al. | 123/90.16 |
| 4,466,390 | 8/1984 | Babitzka et al. | 123/90.12 |
| 4,671,221 | 6/1987 | Geringer et al. | 123/90.12 |
| 4,674,451 | 6/1987 | Rembold et al. | 123/90.12 |
| 4,696,265 | 9/1987 | Norhira | 123/90.16 |
| 4,716,863 | 1/1988 | Pruzan | 123/90.16 |
| 4,765,288 | 8/1988 | Linder et al. | 123/90.16 |

FOREIGN PATENT DOCUMENTS 52-35813 9/1977 Japan .

*Primary Examiner*—Charles J. Myhre
*Assistant Examiner*—Weilun Lo
*Attorney, Agent, or Firm*—Lyon & Lyon

[57] ABSTRACT

A valve operating device for an internal combustion engine that includes a valve piston having one end facing into a damper chamber and the other end operatively coupled to an intake or exhaust valve which is spring-biased in a closing direction. A cam piston has one end operatively coupled to a cam drivable by a crankshaft and the other end disposed in a working oil chamber. A restriction mechanism uniformly restricts oil flow during final valve closing operation of the intake or exhaust valve until the valve is fully closed. The working oil chamber and damper chamber are held in communication with each other through the restriction mechanism. A bypass passage interconnects the damper chamber and the working oil chamber in bypassing relation to the restriction mechanism. A variable restriction mechanism is provided in the bypass passage capable of varying the area for oil flow according to valve closing characteristics required by the viscosity of working oil and operating conditions of the engine.

5 Claims, 5 Drawing Sheets

VALVE OPERATING DEVICE FOR INTERNAL COMBUSTION ENGINE

The present invention relates to a valve operating device for an internal combustion engine including a hydraulically controlled mechanism operatively coupled to an intake or exhaust valve which is spring-biased in a closing direction, wherein the working oil can be selectively released for closing the valve during the opening stroke to reduce the valve lift and open time.

One conventional valve operating device of this type is known from Japanese Patent Publication No. 52-35813, for example. A valve piston has one end facing onto a damper chamber and the other end operatively coupled to the intake or exhaust valve, a cam piston has one end operatively coupled to a cam drivable by a crankshaft, a working oil chamber is provided in which the other end of the cam piston is disposed, and a restriction mechanism causes a restriction of the oil flow from near the end of the valve closing operation of the intake or exhaust valve until the valve is fully closed. The working oil chamber and the damper chamber are held in communication with each other through the restriction mechanism.

In that prior valve operating device, when the intake or exhaust valve is being closed, the flow of working oil from the damper chamber back into the working oil chamber is limited by the restriction mechanism to reduce the speed of closing movement of the intake or exhaust valve for lessening shocks caused when the valve is seated on a valve seat, thus preventing damage to the intake or exhaust valve and other members. The restriction mechanism of the conventional valve operating device, referred to above, provides a fixed restriction and does not take the viscosity of the working oil into account. The speed of operation of the valve piston tends to vary due to a change in the viscosity of the working oil dependent on the temperature thereof. It is often desirable to change the closing characteristics of the intake or exhaust valve dependent on operating conditions of the engine. However, the prior arrangement has failed to meet such a demand.

It is an object of the present invention to provide a valve operating device for an internal combustion engine which is capable of controlling the closing characteristics of an intake or exhaust valve independent of the viscosity of the working oil and in response to operating conditions of the engine.

According to the present invention, a valve operating device has a bypass passage interconnecting the damper chamber and the working oil chamber in bypassing relation to the restriction mechanism, and a variable restriction mechanism capable of varying the cross-sectional area for the oil flow according to valve closing characteristics required by the viscosity of the working oil and operating conditions of the engine. With this above arrangement, by varying the restriction of the variable restriction mechanism to adjust the area for the oil flow through the bypass passage, the amount of working oil flowing from the damper chamber into the working oil chamber can be regulated to control the speed of movement of the valve piston in the valve closing direction according to valve closing characteristics required.

Preferred embodiments of the present invention will hereinafter be described with reference to the drawings wherein.

Figure 1:
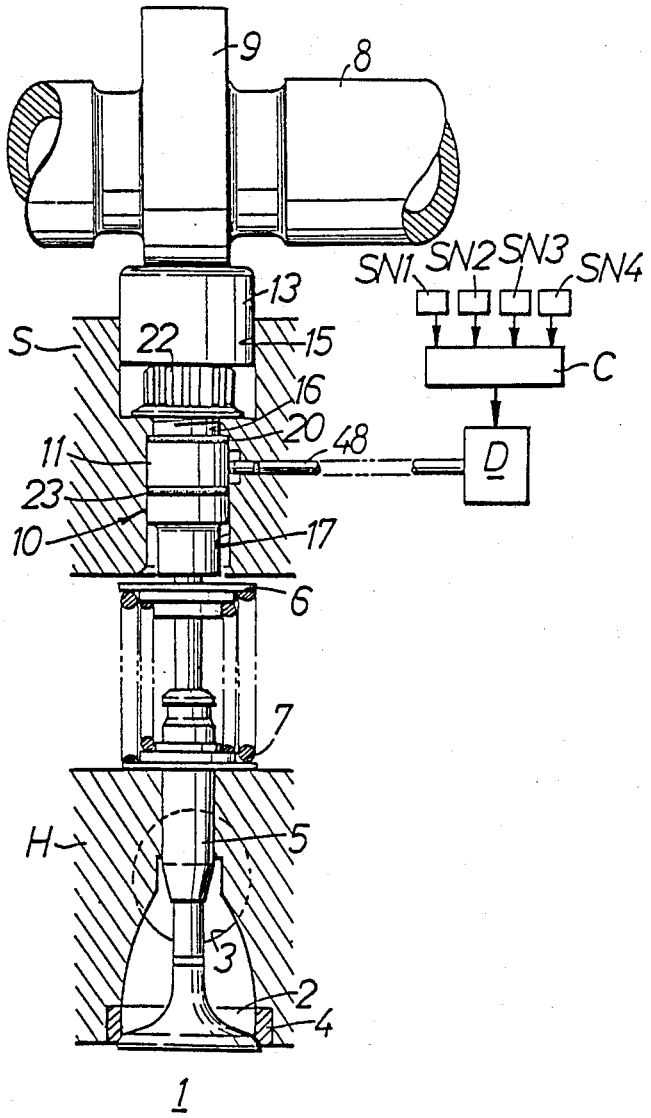
FIG. 1 is a vertical sectional elevational view of an overall arrangement.
Figure 2:
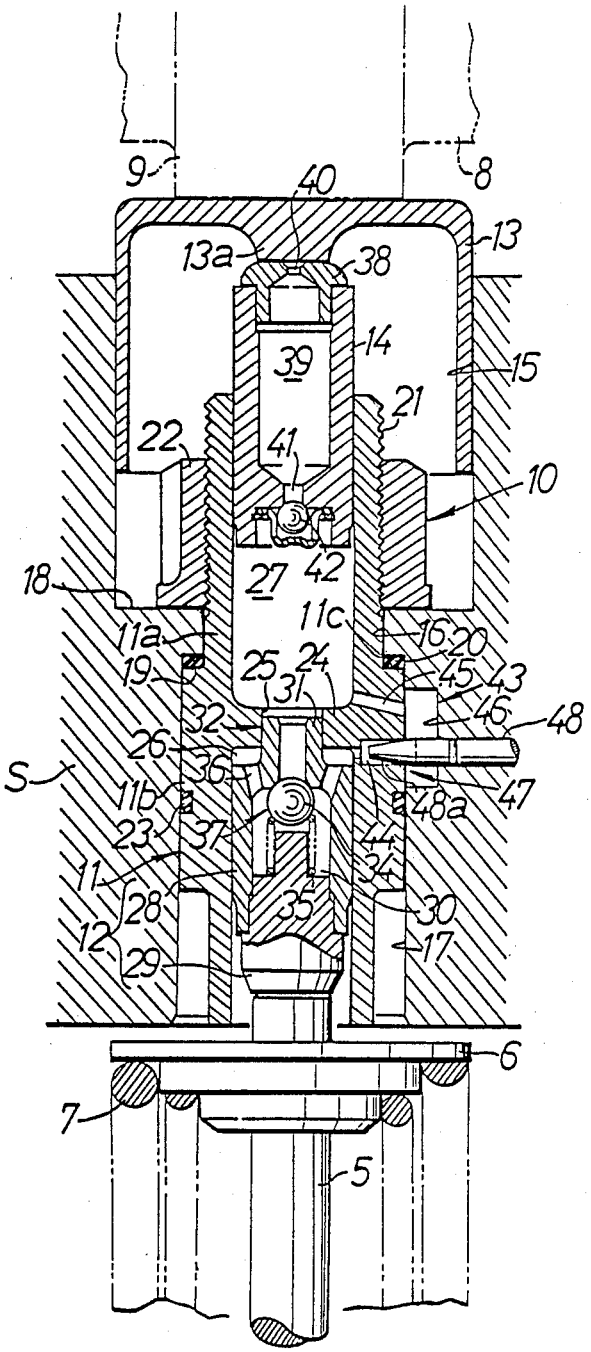
FIG. 2 is an enlarged vertical cross-sectional view of a first embodiment of a hydraulic pressure actuator.
Figure 3:
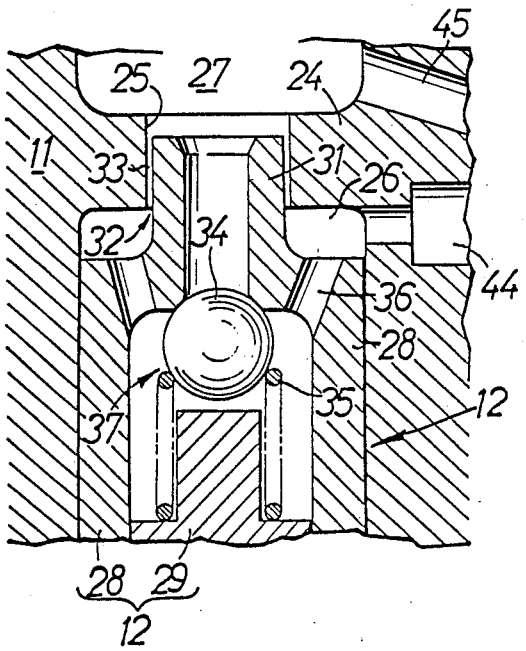
FIG. 3 is an enlarged vertical cross-sectional view of a restriction mechanism of the embodiment of FIG. 2.

A first embodiment of the present invention is shown in FIGS. 1, 2 and 3. As shown in FIG. 1, an internal combustion engine includes a cylinder head H having an intake valve port 2 opening into the upper end of a combustion chamber 1 defined between the cylinder head H and a cylinder block (not shown) therebelow, the intake valve port 2 communicating with an intake port 3. An intake valve 5 which can be seated on a ring-shaped valve seat 4 fixedly disposed in the intake valve port 2 is vertically movably guided by the cylinder head H for opening and closing the intake valve port 2. The intake valve 5 is normally biased upwardly, i.e., in an opening direction under the forces of a valve spring 7 disposed under compression between a flange 6 mounted on the upper end of the intake valve 5 and the cylinder head H.

A camshaft 8 rotatable by a crankshaft (not shown) is rotatably disposed above the cylinder head H. A hydraulic pressure drive device or actuator 10 is disposed between a cam 9 on the camshaft 8 and the upper end of the intake valve 5 for opening and closing the intake valve 5 under a hydraulic pressure dependent on the cam profile of the cam 9.

As illustrated in FIG. 2, the hydraulic pressure actuator 10 has a cylinder 11 fixedly disposed vertically in a support member S fixed to the cylinder head H above the intake valve 5, a valve piston 12 held against the upper end of the intake valve 5 and slidably fitted in a lower portion of the cylinder 11, a lifter 13 slidably held against the cam 9, and a cam piston 14 having an upper end abutting against the lifter 13 and slidably fitted in an upper portion of the cylinder 11.

The support member S has a larger-diameter hole 15, a smaller-diameter hole 16, and a medium-diameter hole 17 defined therein above and vertically coaxially with the intake valve 5. A step 18 is defined between the larger-diameter hole 15 and the smaller-diameter hole 16, and a step 19 is defined between the smaller-diameter hole 16 and the medium-diameter hole 17. The cylinder 11 is of a basically cylindrical shape including a smaller-diameter portion 11*a* inserted in the smaller-diameter hole 16 and a larger-diameter portion 11*b* fitted in the medium-diameter hole 17, the smaller-and larger-diameter portions 11*a*, 11*b* being coaxially joined to each other with an upwardly facing step 11*c* therebetween. The larger-diameter portion 11*b* of the cylinder 11 is fitted in the medium-diameter hole 17 with a shim 20 interposed between the step 11*c* and the step 19 between the smaller- and medium-diameter holes 16, 17 and also with the smaller-diameter portion 11*a* inserted through the smaller-diameter hole 16. A portion of the smaller-diameter portion 11*a* which projects upwardly above the smaller-diameter hole 16 has an externally threaded surface 21. The cylinder 11 is fixed to the support member S by threading a nut 22 over the externally threaded surface 21 until the nut 22 is held against the step 18. An annular seal member 23 is fitted over the outer surface of an intermediate portion of the larger-diameter portion 11*b* of the cylinder 11 to provide a seal between the outer surface of the larger-diameter portion 11*b* and the inner surface of the medium-diameter hole 17.

The cylinder 11 has a radially inward partition wall 24 extending fully circumferentially from the inner surface in its intermediate position. The partition wall 24 has a central communication hole 25 defined coaxially therein. The valve piston 12 and the partition wall 24 define therebetween a damper chamber 26, and the cam piston 14 and the partition wall 24 define therebetween a working oil chamber 27.

The valve piston 12 comprises a slider member 28 slidably fitted in the lower portion of the cylinder 11 with a closed end of the slider member 28 directed upwardly, and an abutment member 29 closing the lower open end of the slider member 28 and abutting against the upper end of the intake valve 5. An oil chamber 30 is defined between the slider member 28 and the abutment member 29. The slider member 28 has a short cylindrical portion 31 disposed coaxially on the upper central end of thereof and insertable into the communication hole 25. The short cylindrical portion 31 and the communication hole 25 jointly constitute a restriction mechanism 32.

As shown in FIG. 3, the outside diameter of the short cylindrical portion 31 is selected such that there is left a gap having a dimension ranging from several tens to several hundreds μm between the outer surface of the cylindrical portion 31 and the inner surface of the communication hole 25. With the short cylindrical portion 31 inserted in the communication hole 25, a thin annular passage 33 is defined between the outer surface of the cylindrical portion 31 and the inner surface of the communication hole 25 for limiting the flow of working oil from the damper chamber 26 into the working oil chamber 27. The thin annular passage 33 is formed only when the short cylindrical portion 31 is inserted in the communication hole 25. The short cylindrical portion 31 has an axial length selected such that it is inserted into the communication hole 25 while the intake valve 5 is in the process of being closed, i.e., the valve piston 12 is being moved upwardly under the bias of the valve spring 7.

A spherical valve body 34 is disposed in the oil chamber 30 of the valve piston 12 for closing the open end of the short cylindrical portion 31 just above the oil chamber 30. The spherical valve body 34 is normally urged in a closing direction by a spring 35 disposed under compression between itself and the abutment member 29. The slider member 28 has through holes 36 defined therein to communicate the oil chamber 30 with the damper chamber 26. The valve body 34 and the spring 35 jointly constitute a one-way valve 37 which is openable to introduce working oil from the short cylindrical portion 31 into the oil chamber 30 when the hydraulic pressure in the short cylindrical portion 31 is higher than that in the oil chamber 30 by a certain value.

When the hydraulic pressure in the working oil chamber 27 is increased with the short cylindrical portion 31 inserted in the communication hole 25, the working oil from the working oil chamber 27 is introduced from the oil chamber 30 into the damper chamber 26 through the one-way valve 37.

When the short cylindrical portion 31 is positioned below the communication hole 25, i.e., the intake valve 5 is depressed and opened, and when the intake valve 5 is in the process of being lifted and closed from the fully open position under the bias of the valve spring 7, the restriction mechanism 32 does not restrict the oil flow. The restriction mechanism 32 restricts the oil flow from the time when the short cylindrical portion 31 is inserted into the communication hole 25 as the intake valve 5 is closed until the intake valve 5 is fully closed.

The cam piston 14 is of a bottomed cylindrical shape with its closed end directed downwardly. The cam piston 14 has an upper open end closed by a closure member 38 which is engageable with the lifter 13. The lifter 13 is also of a bottomed cylindrical shape with the closed end having an outer surface slidably held against the cam 9. The lifter 13 is slidably fitted in the larger-diameter hole 15. The lifter 13 has an abutment projection or land 13*a* on the inner surface of a central portion of the closed end thereof for abutting against the closure member 38 of the cam piston 14.

Between the cam piston 14 and the closure member 38, there is defined a reservoir chamber 39 for storing working oil. The closure member 38 has a through hole 40 defined therethrough for guiding the working oil from the reservoir chamber 39 to mutually sliding surfaces of the lifter 13 and the closure member 38. The closed end of the cam piston 14 has an oil hole 41 which can communicate with the working oil chamber 27 and which is associated with a check valve 42 for allowing the working oil to flow only from the reservoir chamber 39 into the working oil chamber 27.

According to the present invention, the damper chamber 26 and the working oil chamber 27 are interconnected by a bypass passage 43 bypassing the restriction mechanism 32. The bypass passage 43 comprises a first oil passage 44 defined in the cylinder 11 in communication with the damper chamber 26, a second oil passage 45 defined in the cylinder 11 in communication with the working oil chamber 27, and a recess 46 defined in the support member S outwardly of the open ends of the first and second oil passages 44, 45 at the outer surface of the cylinder 11 to provide communication between the first and second oil passages 44, 45. The first oil passage 44 is defined in the radial direction of the cylinder 11.

A variable restriction mechanism 47 is disposed in the bypass passage 43. The variable restriction mechanism 47 is composed of the first oil passage 44 and a needle 48 slidably fitted in the support member S and having a distal end variably insertable into the first oil passage 44. The needle 48 extends radially of the cylinder 11. The distal end of the needle 48 is tapered at 48*a*. The area of the annular flow passage defined between the tapered needle end 48*a* and the open end of the first oil passage 44 which opens into the recess 46 can be adjusted by axial movement of the needle 48. The variable restriction mechanism 47 restricts the oil flow therethrough only when the restriction mechanism 32 restricts the oil flow therethrough. The variable restriction mechanism 47 is fully closed otherwise.

Referring back to FIG. 1, the needle 48 is coupled to a driver means D which is controlled in its operation by a control means C. The control means C controls the operation of the driver means D in response to closing characteristics of the intake valve 5 required by a change in the viscosity of the working oil, the speed of rotation of the engine, the lift characteristics of the intake valve 5, and a change in the timing of opening and closing the intake valve 5. To effect such operation control, the control means C is supplied with signals from four signal generators SN1 through SN4.

More specifically, the first signal generator SN1 supplies the control means C with a signal indicative of the directly measured viscosity of the working oil, or the temperature of the working oil or lubricating oil or cooling water which indirectly represents the viscosity of the working oil. The control means C controls the operation of the driver means D to move the needle 48 axially for reducing the restriction of the variable restriction mechanism 47 when the viscosity of the working oil is high or for increasing the restriction of the variable restriction mechanism 47 when the viscosity of the working oil is low.

The control means C is supplied with a signal indicating the speed of rotation of the engine from the second signal generator SN2. The control means C controls valve seating characteristics (corresponding to a dampening curve) so as to be optimum or constant within an allowable range of different valve seating speeds dependent on the speed of rotation of the engine. For example, when the engine speed is high, the control means C controls the operation of the driver means D to increase the restriction of the variable restriction mechanism 47, and when the engine speed is low, the control means C controls the operation of the driver means D to reduce the restriction of the variable restriction mechanism 47.

The third signal generator SN3 applies a signal indicating the lifted position and lifting speed of the intake valve 5 to the control means C. The control means C thus detects actual operating conditions as affected by the viscosity of the working oil and a deterioration of the working oil, and controls the operation of the driver means D to obtain optimum valve seating characteristics dependent on the detected operating conditions.

The fourth signal generator SN4 supplies a signal indicating a change in the timing of opening and closing the intake valve 5 to the control means C, which controls the operation of the driver means D to obtain optimum valve seating characteristics according to the detected change in the valve opening/closing timing. For example, the control means C controls the driver means D to operate the variable restriction mechanism 47 only when the lifter 13 slidingly contacts a base-circle portion of the cam 9.

Operation of the above embodiment will be described below. When the intake valve 5 is fully closed, the hydraulic pressure actuator 10 is in the position shown in FIG. 2. The lifter 13 is displaced downwardly from the illustrated position by the lobe of cam 9 upon rotation of the camshaft 8. The cam piston 14 is pushed downwardly by the lifter 13 to reduce the volume of the working oil chamber 27. The working oil in the working oil chamber 27 is introduced through the one-way valve 37 into the damper chamber 26. The valve piston 12 is driven downward by the oil pressure to open the intake valve 5 against the resiliency of the valve spring 7.

When the lifter 13 is released of the downward force imposed by the cam 9 after the intake valve 5 has fully been opened, the intake valve 5 is lifted in a closing direction by the spring force of the valve spring 7. While the intake valve 5 is being closed, the valve piston 12 is also lifted to force the working oil to flow from the damper chamber 26 through the communication hole 25 back into the working oil chamber 27. During the valve closing stroke of the intake valve 5, the short cylindrical portion 31 is inserted into the communication hole 25, whereupon the restriction mechanism 32 starts restricting the flow of the working oil from the damper chamber 26 into the working oil chamber 27. Therefore, the speed of the upward movement of the intake valve 5, i.e., the valve closing speed, is reduced while the intake valve 5 is still in the valve closing stroke to permit the intake valve 5 to be gradually seated on the valve seat 4. Shocks which would otherwise be caused when the valve 5 is seated on the valve seat 4 are lessened, and damage to the intake valve 5 and the valve seat 4 is minimized.

The amount by which the flow of the working oil is limited by the restriction mechanism 32 varies dependent on the viscosity of the working oil, i.e., the temperature of the working oil. When the temperature of the working oil is high, i.e., when the viscosity of the working oil is low, a relatively large amount of working oil returns from the damper chamber 2 into the working oil chamber 27. Conversely, when the temperature of the working oil is low, i.e., when the viscosity of the working oil is high, a relatively small amount of working oil flows from the damper chamber 26 back into the working oil chamber 27. Such different amounts of working oil returning from the damper chamber 26 into the working oil chamber 27 would cause different valve closing speeds of the valve piston 12. To prevent this, the area of the flow passage through the variable restriction mechanism 47 disposed in the bypass passage 43 interconnecting the damper chamber 26 and the working oil chamber 27 is varied dependent on the viscosity of the working oil. More specifically, when the temperature of the working oil is low and the viscosity of the working oil is high, the needle valve 48 is moved radially outwardly of the cylinder 11 to increase the area of the flow passage through the variable restriction mechanism 47. When the temperature of the working oil is high and the viscosity of the working oil is low, the needle valve 48 is moved radially inwardly of the cylinder 11 to reduce the area of the flow passage through the variable restriction mechanism 47. The amount of the working oil which returns from the damper chamber 26 to the working oil chamber 27 can thus be kept at a substantially constant level irrespective of the viscosity of the working oil, and hence the speed of movement of the valve piston 12 and the cam piston 14 in the valve closing direction can be maintained substantially constant regardless of the viscosity of the working oil. The restriction of the variable restriction mechanism 47 also may be adjusted in response to dependent on the rotational speed of the engine, a change in the timing of opening and closing the intake valve 5, and the lifted position and lifting speed of the intake valve 5. Consequently, the timing at which the intake valve 5 is seated on the valve seat 4 can be optimized dependent on the operating conditions of the engine.

Figure 5:
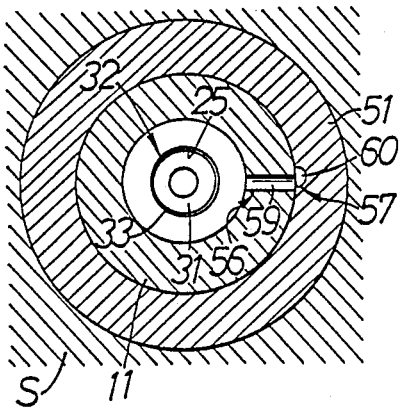
FIG. 5 is a cross-sectional view taken along line V—V of FIG. 4.
Figure 4:
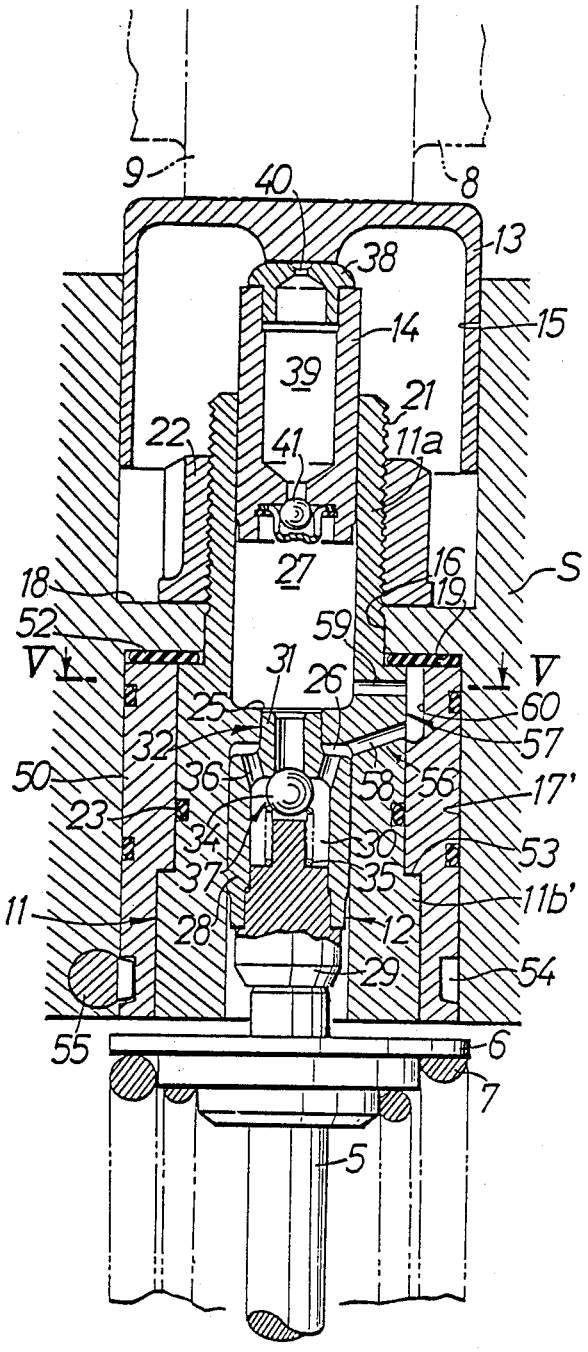
FIG. 4 is a vertical cross-sectional view similar to FIG. 2 of a second embodiment.

FIGS. 4 and 5 illustrate a second embodiment of the present invention. Those parts which are identical to those of the first embodiment are denoted by identical reference numerals and will not be redescribed in detail.

A support member S has a medium-diameter hole 17′ in which a tube 51 coaxially surrounding a larger-diameter portion 11*b*′ of a cylinder 11 is fitted for angular movement about its own axis. A seal member 52 is interposed between the upper end of the tube 51 and step 11*c* of the cylinder 11 and step 1 between the medium-diameter hole 17′ and smaller-diameter hole 16. An upwardly facing engaging step 53 is defined on an intermediate portion of a larger-diameter portion 11b' of the cylinder 11 in engagement with an intermediate inner surface of the tube 51. Thus, the tube 51 is angularly movably sandwiched between the step 19 and the engaging step 53. Teeth 54 are formed on a lower outer surface of the tube 51 and held in mesh with a rack 55 which is axially movably supported in the support member S, the rack 55 being coupled to a driver means (not shown) similar to driver means D shown in FIG. 1.

Between the damper chamber 26 and the working oil chamber 27 there is defined a bypass passage 56 extending in bypassing relation to the restriction mechanism 32 and a variable restriction mechanism 57. The bypass passage 56 comprises a first oil passage 58 defined in the cylinder 11 in communication with the damper chamber 26, a second oil passage 59 defined in the cylinder 11 in communication with the working oil chamber 27, and a communication groove 60 defined in the tube 51 and providing communication between the oil passages 58, 59. The first and second oil passages 58, 59 open at the outer surface of the cylinder 11. The communication groove 60 extends axially along the inner surface of the tube 51 to communicate the oil holes 58, 59 with each other. The variable restriction mechanism 57 is composed of the communication groove 60 and the open ends of the oil passages 58, 59 at the outer surface of the cylinder 11. The cross-sectional area of the flow path through the bypass passage 56 can be adjusted or varied by turning the tube 51 about its own axis to expose more or less of groove 60 to the passages 58, 59 as shown in FIG. 5.

The second embodiment can offer the same advantages as those of the first embodiment by varying the restriction of the variable restriction mechanism 57.

Figure 7:
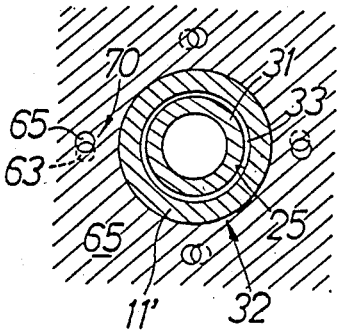
FIG. 7 is a cross-sectional view taken along line VII—VII of FIG. 6.
Figure 6:
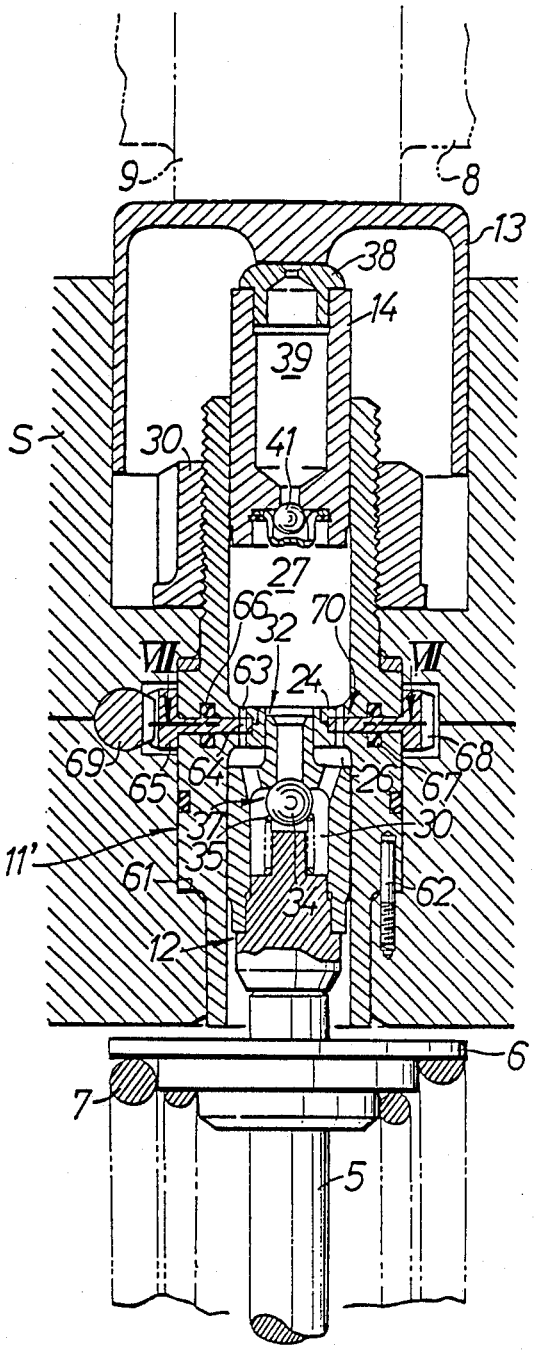
FIG. 6 is a vertical cross-sectional view similar to FIG. 2 of a third embodiment.

FIGS. 6 and 7 illustrate a third embodiment of the present invention. Those components which are identical to those of the first embodiment are denoted by identical reference numerals and will not be redescribed.

A cylinder 11' is divided into upper and lower components by a plane across a partition wall 24 thereof. A support member S is also divided into upper and lower members extending respectively around the upper and lower components of the cylinder 11'. The lower component of the cylinder 11' is supported on a step 61 of the support member S. An engaging pin 62 is mounted on the step 61 and fitted in the lower component of the cylinder 11' to prevent the lower component of the cylinder 11' from rotating about its axis with respect to the support member S.

The partition wall 24 of the cylinder 11' has a plurality of bypass passages 63 interconnecting the damper chamber 26 and the working oil chamber 27 in bypassing relation to the restriction mechanism 32. A turnplate 65 having a plurality of through holes 64 for registration with the respective bypass passages 63 is rotatably supported and interposed between the upper and lower components of the cylinder 11' for angular movement about its own axis coaxial with the cylinder 11'. Seal members 66, 67 are disposed between the cylinder 11' and the turnplate 65. The turnplate 65 has an outer edge projecting radially outwardly from the cylinder 11' with teeth 68 held in mesh with a rack 69 longitudinally movably supported in the support member S and coupled to a driver means (not shown) similar to driver means D of FIG. 1. By turning the turnplate 65, the area in which the through holes 64 overlap the bypass passages 63 can be varied. The bypass passages 63 defined in the partition wall 24 and the through holes 64 defined in the turnplate 65 jointly constitute a variable restriction mechanism 70 for freely adjusting or varying the cross-sectional area of the flow path through the bypass passages 63.

The third embodiment can also offer the same advantages as those of the first and second embodiments by varying the restriction of the variable restriction mechanism 70.

While the valve operating device for the intake valve 5 has been described in the above embodiments, the present invention is equally applicable to a valve operating mechanism for an exhaust valve.

With the present invention, as described above, the bypass passage is provided which interconnects the damper chamber and the working oil chamber in bypassing relation to the restriction mechanism, and the variable restriction mechanism is disposed in the bypass passage for varying the cross-sectional area of the flow passage in response to valve closing characteristics required by the viscosity of the working oil and the operating conditions of the engine. By adjusting or varying the area of the flow passage through the variable restriction mechanism, the amount of the working oil flowing from the damper chamber back into the working oil chamber can freely be regulated irrespective of the fact that the restriction of the restriction mechanism is constant. Therefore, it is possible to adjust the speed of operation of the valve as it is closed to the speed required by the viscosity of the working oil and the operating conditions of the engine.

What is claimed is:

1. In a valve operating device for an internal combustion engine including a valve piston having one end facing into a damper chamber and the other end operatively coupled to an intake or exhaust valve which is spring-biased in a closing direction, a cam piston having one end operatively coupled to a cam drivable by a crankshaft, a working oil chamber in which the other end of the cam piston is disposed, and a restriction mechanism for restricting an oil flow from a predetermined point during valve closing operation of the intake or exhaust valve until the valve is fully closed, said working oil chamber and said damper chamber being held in communication with each other through said restriction mechanism, an improvement comprising, a bypass interconnecting the damper chamber and the working oil chamber in bypassing relation to the restriction mechanism, and a variable restriction mechanism capable of varying a cross-sectional area for oil flow through said bypass passage according to valve closing characteristics required by the viscosity of working oil and operating conditions of the engine.

2. A valve operating device according to claim 1 wherein said variable restriction mechanism includes a needle valve selectively movable with respect to a portion of said bypass passage.

3. A valve operating device according to claim 1, wherein said variable restriction mechanism includes a tubular member having a portion forming a portion of said bypass passage and being rotatable for varying the flow area to said portion of said bypass passage.

4. A valve operating device according to claim 1, wherein said variable restriction mechanism includes a rotatable turnplate having holes therethrough forming a portion of said bypass passage and being rotatable to vary the alignment of said holes with the bypass passage.

5. In a valve operating device for an internal combustion engine including a valve piston operatively coupled to an intake or exhaust valve and communicates with a working oil chamber that is pressurized for operating the valve piston, an improvement comprising a bypass passage for returning the working oil to the working chamber during closing of the intake or exhaust valve, and a variable restriction mechanism capable of varying a cross-sectional area for said returning oil flow through said bypass passage for selectively varying the valve closing characteristics.

* * * * *